United States Patent [19]

Lefebvre

[11] 4,180,121

[45] Dec. 25, 1979

[54] LOW PRESSURE MOLTEN METAL CASTING DEVICE

[75] Inventor: Jean H. Lefebvre, Chaville, France

[73] Assignee: Regie Nationale des Usines Renault, Boulogne-Billancourt, France

[21] Appl. No.: 878,459

[22] Filed: Feb. 16, 1978

[30] Foreign Application Priority Data

Mar. 1, 1977 [FR] France ..... 77 05933

[51] Int. Cl.[2] ..... B22D 17/32; B22D 17/06

[52] U.S. Cl. ..... 164/152; 164/306; 164/156

[58] Field of Search ..... 164/154, 155, 156, 4, 164/119, 284, 306, 308-311, 133, 152

[56] References Cited

U.S. PATENT DOCUMENTS

| | | | |
|---|---|---|---|
| 3,591,052 | 6/1971 | Nef | 164/156 |
| 3,761,218 | 9/1973 | Portalier | 164/119 |
| 3,880,222 | 4/1975 | Chatourel et al. | 164/119 |

OTHER PUBLICATIONS

"The German Printed Publication" No. 1,124,195, Auslegeschrift 2/62.

"The German Printed Publication" No. 2,111,462, Offenlegungsschrift, 9/72.

*Primary Examiner*—Robert D. Baldwin
*Assistant Examiner*—K. Y. Lin
*Attorney, Agent, or Firm*—Fleit & Jacobson

[57] ABSTRACT

A low-pressure molten metal casting device comprising a level detector or sensor disposed in a column disposed downstream of the smelting furnace and upstream of the casting leading inlet feed openings of a distribution chamber connected to the moulds. This sensor co-acts with a mechanism controlling the pressure of an inert gas in the furnace for regulating the metallostatic casting overpressure as a function of the selected casting level in order to monitor the furnace pressure and consequently the casting by moving the sensor according to a predetermined law or with the assistance of the gas pressure in the column, so as to reduce any idle periods between successive castings cycles by pre-rising the molten metal by using the level sensor, the latter comprising preferably a pair of staggered electrodes.

13 Claims, 5 Drawing Figures

LOW PRESSURE MOLTEN METAL CASTING DEVICE

This invention relates to low-pressure molten metal casting devices, of the type comprising a chamber provided with one or more inlet feed openings for one or a plurality of moulds, and a casting conduit connecting this chamber to a metal smelting furnace adapted to be connected in turn to a source of fluid under pressure for feeding said chamber by causing the metal to rise therein.

Adjusting the pressure in the furnace will determine the casting overpressure in the mould and if the pressure increment rate in the furnace is not properly selected or if a misadjustment occurs, the shock wave or "fluid hammering" developing at the end of the mould filling operation may give rise to various defects such as:

- causing the sand cores to be marked as a consequence of the penetration of molten metal into the pores thereof;
- clogging of air drafts in the metal moulds by metal burrs;
- causing molten metal to penetrate into the mould joints, etc.

It is already known through the French Pat. No. 2 213 825 to use a column disposed downstream of the furnace and upstream of the aforesaid leading feed opening or openings for casting the molten metal into the mould or moulds, this column constituting a buffer reservoir for the molten metal and at the same time a conduit for supplying neutral scavenging gas.

With this arrangement, the above-mentioned inconveniences are more or less alleviated and it is the essential object of the present invention to obtain further improvements in this direction in order to ensure an improved construction and control of a low-pressure casting plant of this character.

For this purpose, the present invention is characterized essentially in that it provides a low-pressure molten metal casting device comprising in said column a level sensor or detector co-acting with means for controlling the pressure of the molten metal in the furnace in order to adjust a metallostatic casting overpressure depending on the selected level. This invention further provides other advantageous arrangements as will be explained presently, notably for the purpose of monitoring the furnace pressure and therefore the casting by displacing the level sensor according to a predetermined law or with the assistance of the gas pressure in said column, and also of reducing idle periods between two successive casting operations by picking up metal under the control of the aforesaid level sensor.

Two different forms of embodiment of casting devices according to this invention will now be described by way of illustration, not of limitation, with reference to the accompanying drawing, in which.

Figure 1:
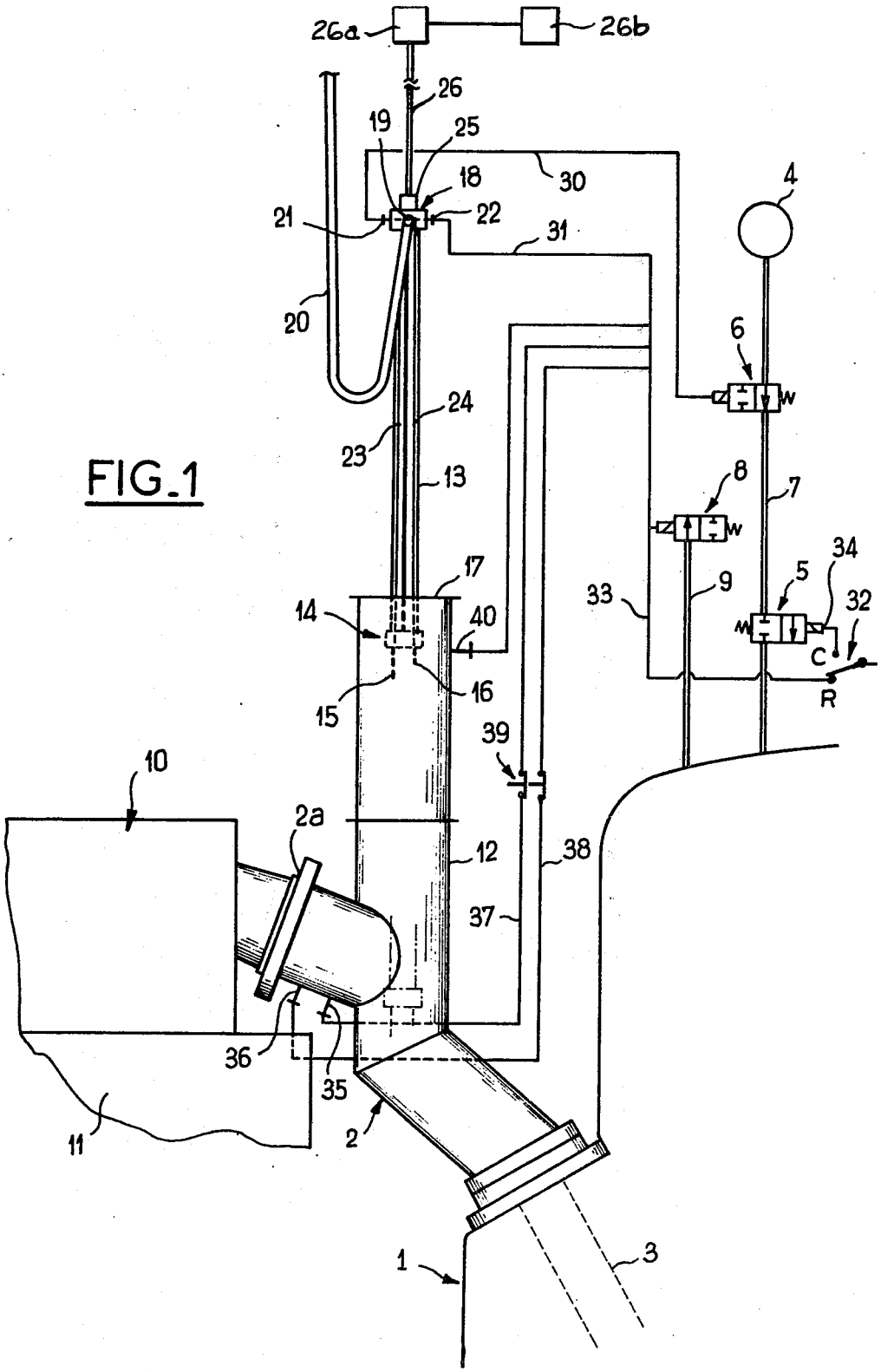
FIG. 1 is a diagrammatic comprehensive view of a casting device according to this invention.

The low-pressure molten-metal casting device illustrated in FIG. 1 comprises a metal smelter 1 to which a casting conduit 2 is connected. The molten metal is thus caused to rise into this casting conduit 2 through a dipper tube or pipe 3 as a consequence of the application of pneumatic pressure to the surface of the liquid mass of molten metal, the compressed air being supplied by a suitable and known source shown diagrammatically at 4.

As will be explained more in detail presently, this pneumatic pressure is adjusted with the assistance of a pair of solenoid valves 5 and 6 inserted in series in the compressed-air feed line 7, and also of another solenoid valve 8 inserted in the pipe 9 through which the furnace atmosphere is vented to the outside.

The casting conduit 2 is connected at **2*a* to the inlet pipe of a casting distribution chamber (not shown) adapted to feed molten metal to at least one casting mould displaceably mounted on a mould press frame structure 11 according to the conventional system. Branched off the casting conduit 2 and comprising at its upper portion a neutral-gas inlet means is a column 12 rising well above the mould 10. This neutral-gas inlet means is formed through a tube 13 supporting a level sensor 14 comprising two staggered electrodes 15, 16 adapted to co-act by electric contact with the molten metal forced by the air pressure up the column 12. The tubular support 13 is in fluid-tight engagement with an orifice formed in a cover 17 closing the top of said column and carries at its upper end a stopper 18 provided on the one hand with an inlet pipe 19 for connecting this stopper 18 to a conduit 20 leading to a source of neutral gas under pressure (not shown) and on the other hand with a pair of insulated terminals 21, 22 connected via a pair of conductors 23, 24 disposed within the tube 13 to the aforesaid electrodes 15 and 16, respectively. Said stopper 18 further comprises a tapped union 25 adapted to receive the screwthreaded end of a rod 26 for controlling the vertical position of said level sensor; if desired, this rod 26 may be the piston-rod of a pressure-fluid cylinder 26*a* or a rod responsive to an electromechanical programmed control device 26*b***, for reasons to be explained presently.

Figure 2:
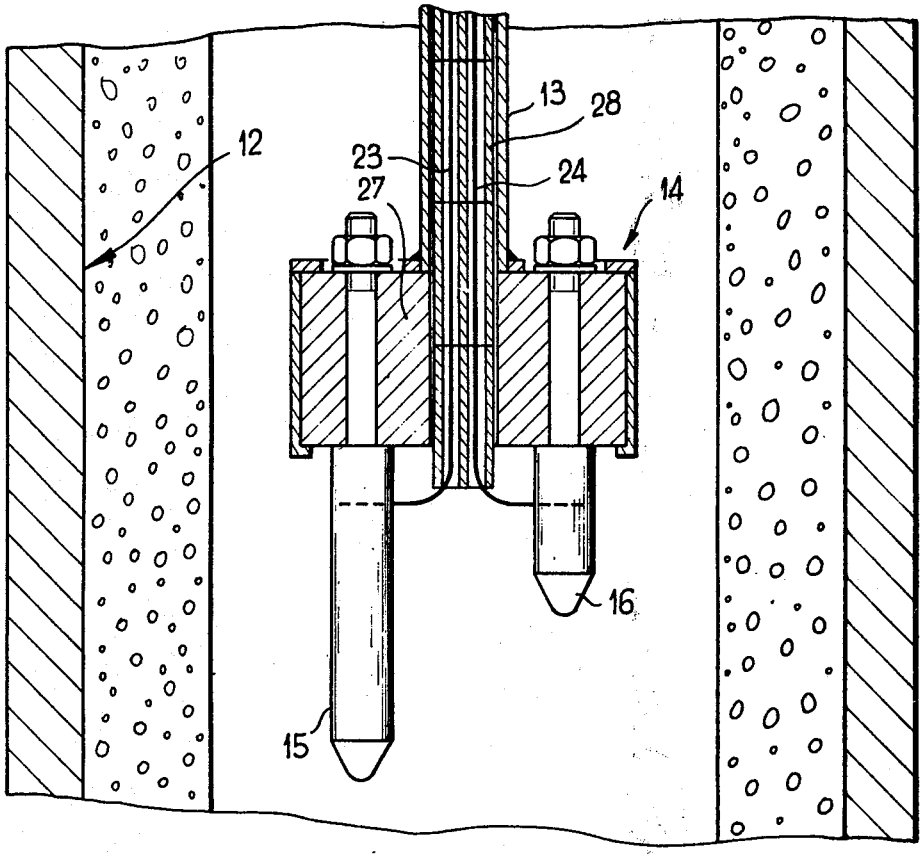
FIG. 2 is a detail view showing in axial section a typical form of embodiment of the lower portion of the level detector.
Figure 3:
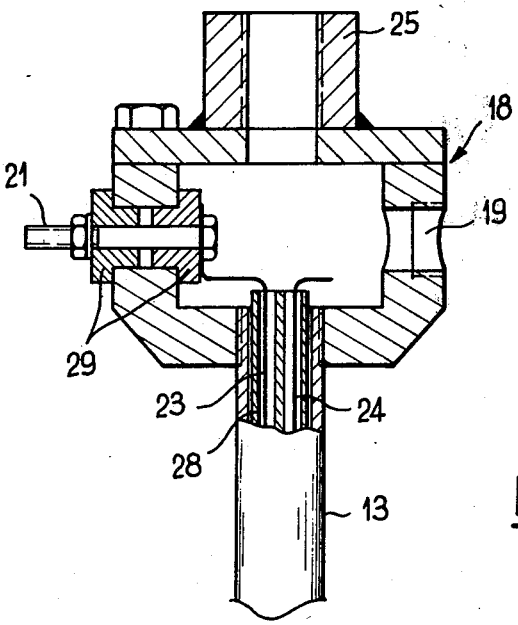
FIG. 3 is a detail view showing in half-section taken at 90° a typical form of embodiment of the upper portion of the level detector.

FIGS. 2 and 3 illustrate an exemplary form of embodiment of a mounting of this type, in which the insulated mounting of electrodes 15 and 16 on a lower insulating block 27 secured to the bottom end of tube 13, the passageways for conductors 23, 24 enclosed in insulating sheaths 28 and the mounting of insulating sockets 29 for terminals 21 and 22, are clearly shown.

The terminal 21 connected to electrode 15 is also electrically connected via a conductor 30 to the control coil of solenoid valve 6. The terminal 22 connected to the electrode 16 is also electrically connected via a conductor 31 to the control coil of solenoid valve 8.

An inverter 32 of the manual or automatic control type becoming operative at each casting cycle comprises a position R in which its movable contact blade is connected electrically by means of a conductor 33 to the control coil of solenoid valve 8 and a position C in which its movable contact blade is connected electrically via a conductor 34 to the control coil of solenoid valve 5. It will be seen that the movable contact blade of inverter 32 is electrically connected to one terminal of a source of electric current (not shown), the same terminal being electrically connected to the metal contained in the furnace, while the other terminal of the source is connected to the terminals (not shown) of the coils controlling said solenoid valves 5, 6 and 8. These valves are shown in the position they occupy in the inoperative condition of the device but with the current turned on (position R of inverter 32), i.e. with the solenoid valve 5 urged by spring means to its position closing the feed conduit 7, while the coil of solenoid valve 8 is energized to open the conduit 9 venting the furnace to the atmosphere. Then solenoid valve 6 is urged by spring means to the position corresponding to the opening of feed conduit 7.

A first casting procedure afforded by this device consists in operating under a predetermined metallostatic casting overpressure selected by properly adjusting the vertical position of level sensor 14 in column 12. In this case, when the inverter 32 is moved to position C, the solenoid valve 5 is energized to open the feed conduit 7 while the solenoid valve 8 moves to its position closing the venting conduit 9 leading to the atmosphere, the compressed air being introduced into the furnace. The molten-metal bath in the furnace is thus driven up the casting conduit 2 and flows into the distribution chamber supplying the inlet casting ports or like openings of mould 10 and also into column 12 until its level rises to that of electrodes 15, 16 of level sensor 14. In fact, when the liquid metal contacts the electrode 15, the control coil of solenoid valve 6 is energized, thus closing the latter and discontinuing the delivery of compressed air to the furnace. If the level of molten metal, due to inertia or overpressure resulting from the expansion of the air contained in the furnace, continues to rise until it contacts the other electrode 16, it causes the control coil of solenoid valve 8 to be energized, and therefore the air contained in the furnace to be vented, thus causing the level of molten metal in column 12 to drop. Consequently, during the casting operation the level of molten metal in column 12 is adjusted with a certain back-lash or delay, depending on the difference of level between the two electrodes 15, 16 which may be chosen by resorting to the test-and-try method, this level regulation producing a casting metallostatic overpressure subordinate to the difference between the thus regulated level and the level of the feed inlet ports of the mould or moulds being cast.

As a result of this particular regulation technique, any risk of causing hammering as usually observed at the end of the mould filling operation is safely avoided, this being particularly advantageous in the case of castings comprising cores, such as cylinder-heads, induction manifolds, etc. or in the case of compound or complex moulds such as piston moulds, or when it is desired to cast only in moulds consisting entirely of sand.

Of course, this regulation is highly advantageous for regularizing the casting output in automatic casting operations, since it increases appreciably the output adjustment sensitivity.

It will be readily understood by those conversant with the art that according to another casting procedure applicable with this improved device the metallostatic overpressure implemented can easily be monitored during the casting cycle by simply shifting the level sensor 14 vertically in column 12 according to a law corresponding to the law governing the selected casting overpressure evolution.

Furthermore, with this device it is possible, by resorting to a modified version thereof, to monitor the casting pressure by controlling the value of the pressure of the inert gas introduced in this example via conduit 20 and support tube 13 of sensor 14, this introduction being also possible, of course, directly through the top of column 12 via a pressure adjuster (not shown) possibly responsive to the casting control cycle. An arrangement of this character is particularly advantageous at the end of the casting operation in order to obtain a final overpressure controlled during the setting of the metal in the mould and before opening the latter for stripping the casting.

In fact, it is obvious that by increasing the pressure of the inert gas above the level of the liquid metal present in column 12 (the level of this metal being adjusted as explained in the foregoing), when this level has dropped below that of electrode 15, the control coil of solenoid valve 6 will be deenergized, i.e. the valve 6 will switch to the position in which compressed air is allowed to flow therethrough to the furnace, until the level of molten metal in column 12 rises sufficiently to restore the contact between the metal and the same electrode 15, the previous regulation being thus maintained with a pressure (both in the furnace and through the casting inlets) responsive to the inert gas pressure in column 12.

In fact, it will be readily understood that by increasing the pressure of the inert gas above the molten metal present in column 12 (the level of this metal being regulated as explained in the foregoing), when the level of this molten metal in column 12 has dropped below that of electrode 15, the control coil of solenoid valve 6 is de-energized, thus switching this valve to the position allowing the ingress of compressed air into the furnace, until the molten metal level in column 12 rises to restore its contact with electrode 15, the preceding regulation being thus allowed to continue with a pressure, both in the furnace and in the casting circuit, responsive to that of the inert gas in column 12.

At the end of the casting cycle, inverter 32 is restored to position R, whereby solenoid valve 5 resumes its position in which the feed conduit 7 is closed and solenoid valve 8 is open for venting the furnace atmosphere, that is, causing the liquid metal present in the distribution chamber, column 12 and casting conduit 2 to flow back into the furnace, so that the mould or moulds can be opened for stripping the castings. This back flow of molten metal is attended by the scavenging of the corresponding casting circuit by the neutral gas flowing in column 12 and escaping to the surrounding atmosphere through the casting ports of the distribution chamber, whereby the formation of oxide "skins" or scales in the casting circuit can safely be avoided while, in the present instance, warranting a good quality of the electric contacts between the sensor electrodes and the molten metal.

The casting device according to this invention is also advantageous in that it affords a substantial increment in the production rate by turning the presence of the level sensor into account for determining again a controlled rise of the molten metal before the mould is re-closed in view of a subsequent casting cycle.

For this purpose, the level sensor 14 is mounted for vertical adjustment down to a position lower than that of the casting ports or openings of the distribution chamber, i.e. the casting feed openings for casting the mould or moulds. As shown in the example illustrated in FIG. 1, this level sensor 14 can be shifted down to the lowest position of the electrodes 15 and 16 shown in dash and dot lines in the Figure, after exhausting the furnace atmosphere at the end of the casting operation, concomitantly with the scavenging of the casting circuit by the neutral gas, as already explained in the foregoing.

With sensor 14 in this position, the injection of compressed air into the furnace is restored by switching the inverter 32 to position C before re-closing the mould in view of the subsequent casting operation, so that the molten metal is raised again and in advance in the casting conduit 2 until it reaches electrode 15 and possibly electrode 16 of level sensor 14, which electrodes prevent the liquid metal from overstepping this point of approach of the casting ports or openings. Under these conditions, it will be readily understood that, when the mould or moulds is or are re-closed, it is only necessary to lift the level sensor 14 in column 12 up to the desired level for the beginning of the casting operation or the complete casting operation according as it is desired to adhere or not to an evolutive law governing the casting overpressure. This mode of operation affords a substantial increment in the production rate in plants of this type, this increment being in the most favourable cases of the order of 10%.

With this method of raising the level of the molten metal preliminary to the mould re-closing step, it is also possible of course to provide safety means directed to positively prevent the casting of molten metal as long as the mould is open, and this safety feature is illustrated diagrammatically in FIG. 1 in the form of a pair of pyrometric contacts 35, 36 disposed on the casting conduit above the level whereat molten metal is normally pre-elevated under the control of sensor 14 in a lower position.

These contacts 35, 36 are connected via conductors 37, 38 respectively to conductor 31 connected in turn to the control coil of solenoid valve 8 through which the furnace atmosphere is vented to the external atmosphere, the corresponding circuit however being validated only through the medium of a contact 39 which is closed only when the mould is open, i.e. normally open when the mould is closed and during the casting operation. Another safety pyrometric contact is also illustrated at 40 and disposed slightly below the top of column 12 to prevent any untimely rise of molten metal therein in case of failure of level sensor 14, this contact being connected for this purpose directly to conductor 31 leading to the control coil of solenoid valve 8 for venting the furnace atmosphere to the external atmosphere.

Of course, the complete casting circuit may be heated in any suitable manner in order to keep the metal in liquid state therein. More particularly, the casting conduit, the distribution chamber and the column may be heated by means of external gas burners or electrically, and in this last case, notably, by means of heating electric resistances of the dipper rod types. The casting circuit may also be heat insulated, notably at its lower portion, by means of refractory materials as conventional in the art.

Figure 4:
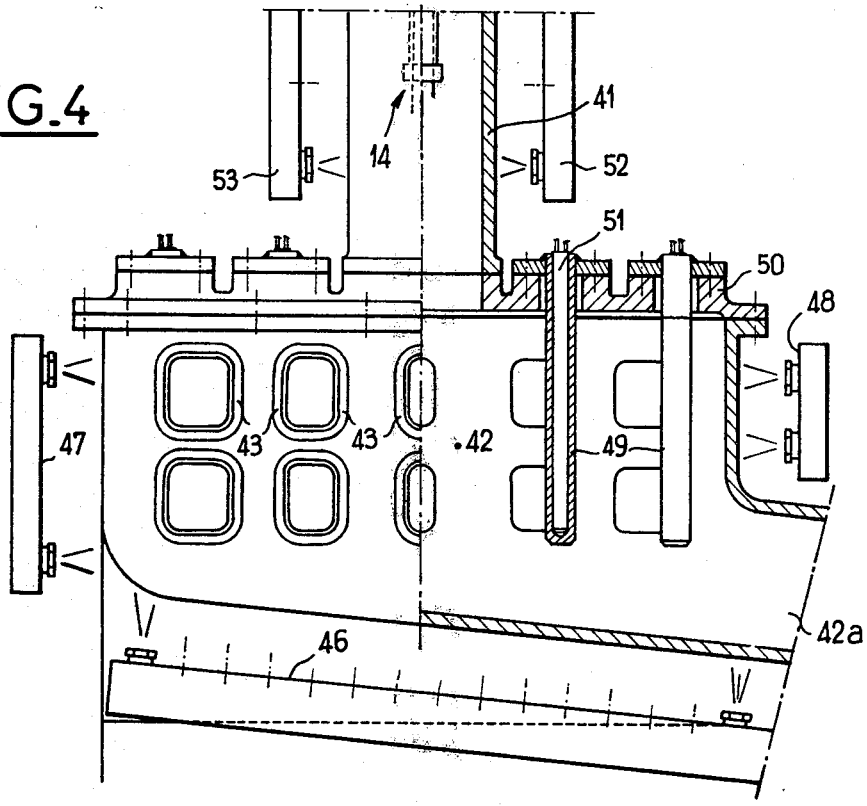
FIG. 4 illustrates a typical form of embodiment of a column connected to the casting distribution chamber shown only partially in side elevational view and in vertical section.
Figure 5:
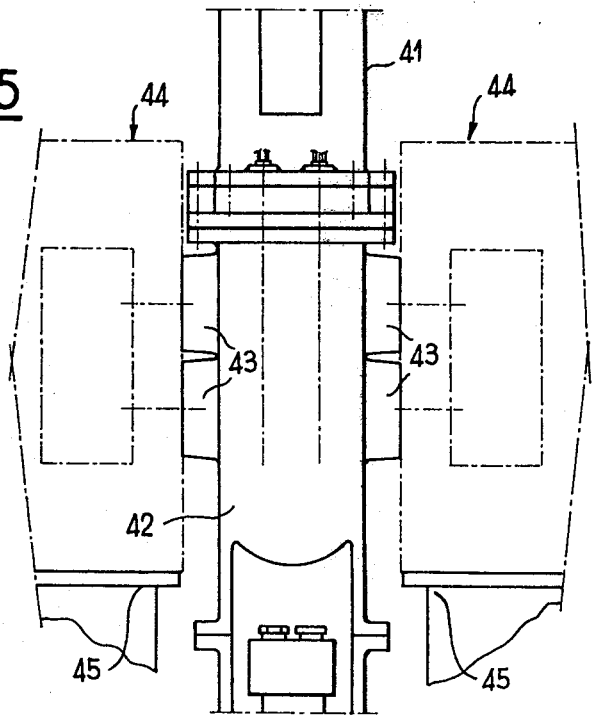
FIG. 5 is a front elevational view of the arrangement shown in FIG. 4.

FIGS. 4 and 5 illustrate a modified form of embodiment of a casting device constructed according to the teaching of the present invention. In this exemplary application of the invention a column 41 having a function equivalent to that devolved to column 12 of the preceding example is connected directly to a distribution chamber 42 comprising a lower connecting nozzle **42*a* leading to a casting conduit (not shown) and connected on the other hand to the furnace like the preceding conduit 2**.

The distribution chamber 42 is provided with a plurality of lateral outlet pipes 43 having different cross-sectional passage areas and adapted to feed the inlet ports of a pair of moulds 44 mounted for lateral movement on either side of the chamber on a frame structure 45, said moulds being shown in their closed condition and ready for the casting operation.

The distribution chamber 42 is heated externally by means of a row of gas burners 46, 47, 48 and also internally by means of dipper rods 49 secured to the cover 50 of chamber 42 and incorporating coated electrical resistances 51. The column 41 has its bottom bolted to the aforesaid cover 50 and is heated by means of a row of gas burners 52, 53.

In this column 41 there is shown partially the lower portion of a level sensor such as the sensor 14 illustrated in the preceding form of embodiment, and producing the same casting effects as those described in the foregoing.

Of course, many modifications and changes may be brought to the specific forms of embodiment shown and described herein without departing from the basic principles of the invention set forth in the appended claims. Thus, notably, any other form of level sensing means utilizing a single electric contact co-acting with suitable means for controlling the air pressure in the furnace may be contemplated within the scope of the invention, the present form of embodiment with two contacts constituting only a preferred arrangement for the simple, sufficient and reliable regulation contemplated. Similarly, the sensors may be of any other type outside the electric-contact ones described herein, and magnetic sensors may also be used for the same purpose.

The neutral gas compressed in the column by the rising metal is either forced back to its supply conduit, since its pressure is relatively low, or discharged through an overload valve (not shown) located on the top of the column.

What is claimed as new is:

1. Device for casting low-pressure molten metal, which comprises a chamber provided with at least one inlet feed opening for at least one mould and a casting conduit connecting said chamber to a metal smelting furnace, said chamber being adapted to be connected in turn to a source of fluid under pressure for feeding molten metal to said chamber by raising the molten metal therein; a column disposed downstream of the furnace and upstream of said at least one inlet feed opening and extending upwards to a level higher than said chamber, said column constituting a buffer reservoir for the molten metal and a feed conduit for a neutral scavenging gas; and a level sensor provided in said column and adapted to co-act with means for controlling the molten metal pressure in the furnace in order to adjust a metallostatic pressure subordinate to a selected level, the level sensor being mounted for displacement down to a position lower than that of the at least one inlet feed opening, said level sensor being shifted at the end of a casting operation after venting fluid used for pressurizing the furnace and returning the metal to said furnace, in order to cause another rise of molten metal up to said lower position of the sensor before re-closing the at least one mould for a subsequent casting cycle.

2. Casting device according to claim 1, wherein means are provided for introducing neutral gas into the upper portion of said column under a pressure capable, in combination with the action of said level sensor, to monitor the pressure in said furnace and therefore the total casting pressure, notably after the at least one mould has been filled up.

3. Casting device according to claim 1, wherein said level sensor comprises a pair of sensitive members disposed in vertically staggered relationship and co-acting with said control means, a first lower member co-acting with a member controlling the turning off of the supply of fluid under pressure to the furnace, the other upper member co-acting with means for venting the fluid used for pressurizing the furnace.

4. Casting device according to claim 1, wherein said column is branched off said casting conduit.

5. Casting device according to claim 1, characterized in that there is provided in one of said chamber and said casting conduit, above the metal level corresponding to said lower position of the level sensor, at least one sensitive member capable of detecting the presence of molten metal, said sensitive member becoming operative with respect to the means controlling the pressure in the furnace during the mould opening period in order to palliate any possible deficiency of the level sensor.

6. Casting device according to claim 1, characterized in that there is provided in said column, above the uppermost position in which said level sensor may be set, at least one sensitive member capable of detecting the presence of molten metal and co-acting with the means controlling the pressure in the furnace for palliating any possible deficiency of the level sensor.

7. Casting device according to claim 1, further comprising a control device programmed as a function of a predetermined law governing casting metallostatic overpressure and means responsive to said control device for driving said level sensor vertically.

8. Casting device according to claim 2, further comprising a control device programmed as a function of a predetermined law governing casting metallostatic overpressure and means responsive to said control device for driving said level sensor vertically.

9. Device for casting low-pressure molten metal, which comprises a chamber provided with at least one inlet feed opening for at least one mould and a casting conduit connecting said chamber to a metal smelting furnace, said chamber being adapted to be connected in turn to a source of fluid under pressure for feeding molten metal to said chamber by raising the molten metal therein; a column disposed downstream of the furnace and upstream of said at least one inlet feed opening and extending upwards to a level higher than said chamber, said column constituting a buffer reservoir for the molten metal and a feed conduit for a neutral scavenging gas; and a level sensor provided in said column and adapted to co-act with means for controlling the molten metal pressure in the furnace in order to adjust a metallostatic pressure subordinate to the selected level, said level sensor comprising a pair of sensitive members disposed in vertically staggered relationship and co-acting with said control means, a first lower member co-acting with a member controlling the turning off of the supply of fluid under pressure to the furnace, the other upper member co-acting with means for venting the fluid used for pressurizing the furnace.

10. Casting device according to claim 9, wherein means are provided for introducing neutral gas into the upper portion of said column under a pressure capable, in combination with the action of said level sensor, to monitor the pressure in said furnace and therefore the total casting pressure, notably after the at least one mould has been filled up.

11. Casting device according to claim 9, wherein said column is branched off said casting conduit.

12. Casting device according to claim 9, characterized in that there is provided in said column, above an uppermost position in which said level sensor may be set, at least one sensitive member capable of detecting the presence of molten metal and co-acting with the means controlling the pressure in the furnace for palliating any possible deficiency of the level sensor.

13. Casting device according to claim 9, further comprising a control device programmed as a function of a predetermined law governing the casting metallostatic overpressure and means responsive to said control device for driving said sensor vertically.

* * * * *